US010934740B2

(12) United States Patent
Timm

(10) Patent No.: US 10,934,740 B2
(45) Date of Patent: Mar. 2, 2021

(54) TENT SHELTER

(71) Applicant: Seek Outside, Inc., Ridgway, CO (US)

(72) Inventor: Kevin Timm, Ridgway, CO (US)

(73) Assignee: Seek Outside, Inc., Ridgway, CO (US)

( * ) Notice: Subject to any disclaimer, the term of this patent is extended or adjusted under 35 U.S.C. 154(b) by 0 days.

(21) Appl. No.: 16/746,296

(22) Filed: Jan. 17, 2020

(65) Prior Publication Data

US 2020/0240170 A1 Jul. 30, 2020

Related U.S. Application Data

(60) Provisional application No. 62/863,942, filed on Jun. 20, 2019, provisional application No. 62/797,859, filed on Jan. 28, 2019.

(51) Int. Cl.
*E04H 15/54* (2006.01)
*E04H 15/32* (2006.01)

(52) U.S. Cl.
CPC ..... *E04H 15/54* (2013.01); *E04H 2015/328* (2013.01)

(58) Field of Classification Search
CPC ..... E04H 15/54; E04H 15/58; E04H 15/32; E04H 2015/328; E04H 15/30; A45F 4/04
USPC ..... 135/115, 117, 119, 124, 906
See application file for complete search history.

(56) References Cited

U.S. PATENT DOCUMENTS 806,802 A * 12/1905 Gulline ..... E04H 15/48 135/153
2,567,697 A * 9/1951 Craighead, Jr. ..... E04H 15/04 135/90
2,742,912 A * 4/1956 Blanchard ..... E04H 15/42 135/94
3,534,750 A * 10/1970 Kolozsvary ..... E04H 15/38 135/132
4,068,674 A * 1/1978 Mitchell ..... E04H 15/20 52/2.21
4,198,997 A * 4/1980 Miller ..... E04H 15/04 135/116
5,806,547 A * 9/1998 Derlinga ..... A45B 23/00 135/117
6,192,909 B1 * 2/2001 Strausser ..... E04H 15/40 135/116
6,499,497 B1 * 12/2002 Swetish ..... E04H 15/16 135/115
7,134,443 B1 * 11/2006 Shires ..... E04H 15/36 135/124
7,146,996 B1 * 12/2006 Shires ..... E04H 15/36 135/126

(Continued)

OTHER PUBLICATIONS

Exped. Vela I UL. Website, www.exped.com, originally downloaded Jan. 17, 2020, 2 pages.

(Continued)

*Primary Examiner* — Noah Chandler Hawk

(74) *Attorney, Agent, or Firm* — Craig R. Miles; CR Miles P.C.

(57) ABSTRACT

A shelter or tent having at least a pair of outer cover panels each upwardly extending from an outer cover panel lower edge to an outer cover ridgeline and a vestibule panel coupled to the outer cover panels which slidably couples to a tensioned guyline to travel between a vestibule closed condition and a vestibule open condition.

14 Claims, 10 Drawing Sheets

(56) References Cited

U.S. PATENT DOCUMENTS

| | | | | |
|---|---|---|---|---|
| 7,316,239 | B2 * | 1/2008 | Yang | E04H 15/003 135/117 |
| 7,406,977 | B1 * | 8/2008 | Shires | E04H 15/26 135/115 |
| 7,789,098 | B2 * | 9/2010 | Livacich | E04H 15/48 135/115 |
| 7,841,356 | B2 * | 11/2010 | Shires | E04H 15/36 135/136 |
| 8,056,572 | B2 * | 11/2011 | Livacich | A01M 31/025 135/98 |
| 8,684,020 | B1 * | 4/2014 | Shires | E04H 15/00 135/87 |
| 8,915,258 | B1 * | 12/2014 | Beam | E04H 15/001 135/117 |
| 2001/0042563 | A1 * | 11/2001 | Coupounas | E04H 15/36 135/124 |
| 2005/0000555 | A1 * | 1/2005 | Besse | E04H 15/14 135/117 |
| 2020/0165835 | A1 * | 5/2020 | Shires | E04H 15/26 |
| 2020/0208431 | A1 | 7/2020 | Durston | |

OTHER PUBLICATIONS

YOUTUBE. Exped Vela 1 Extreme. Video, https://www.youtube.com/watch?v=LOr5vTpxn9w, published Jul. 13, 2013.
U.S. Appl. No. 62/863,942, filed Jun. 20, 2019.
U.S. Appl. No. 62/797,859, filed Jan. 28, 2019.

* cited by examiner

TENT SHELTER

This United States Non-Provisional patent application claims the benefit of U.S. Provisional Patent Application No. 62/863,942, filed Jun. 20, 2019, and U.S. Provisional Patent Application No. 62/797,859, filed Jan. 28, 2019, each hereby incorporated by reference herein.

I. FIELD OF THE INVENTION

The present invention generally relates to shelters or tents and specifically to a vestibule panel attachable to a shelter or a tent which slidably couples to a tensioned guyline to travel between a vestibule closed condition and a vestibule open condition.

II. A BRIEF DESCRIPTION OF THE DRAWINGS

III. DETAILED DESCRIPTION OF THE PREFERRED EMBODIMENTS

Figure 1:
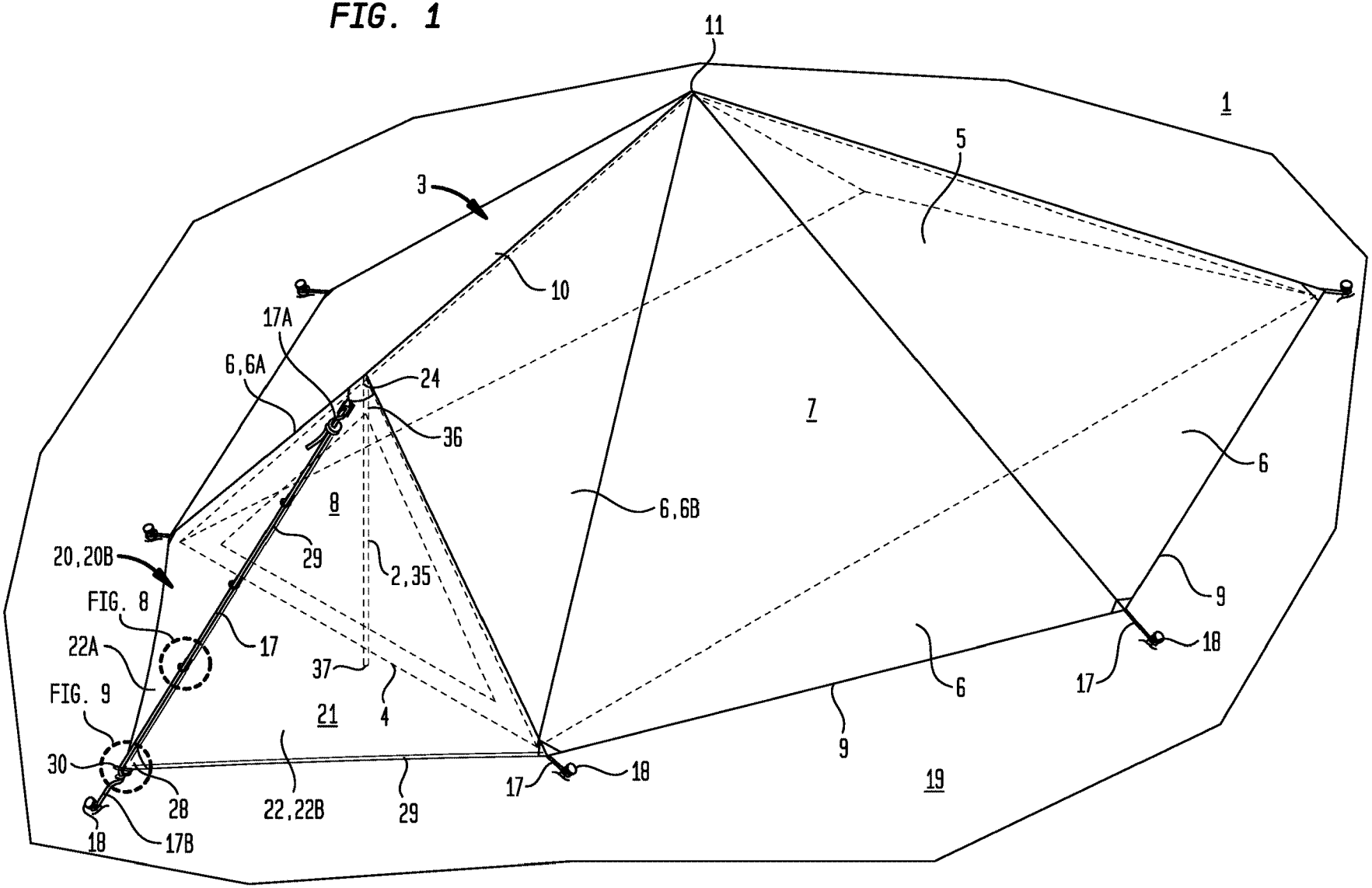
FIG. 1 is an illustration of a particular embodiment of a tent structure including a vestibule cover in the closed condition.

Now referring primarily to FIGS. 1 through 9, tent structures (1) can utilize a tent support structure (2) which when assembled forms a framework upon which a tent cover (3) can be supported or suspended. In particular embodiments, the tent cover (3) includes a tent inner cover (4) which breathes to allow moisture to be transmitted through the tent inner cover (4) and avoids condensate from forming and a tent outer cover (5) which overlays the tent inner cover (4). The tent outer cover (5) can be water proof to prevent the transmission of moisture to the tent inner cover (4). The dead space between the tent inner cover (4) and the tent outer cover (5) can further act as an insulator to prevent the transfer if heat from inside the tent structure (1) to outside the tent structure (1). In particular embodiments, only a tent inner cover (4) or only a tent outer cover (5) may be utilized which can reduce weight.

Figure 2:
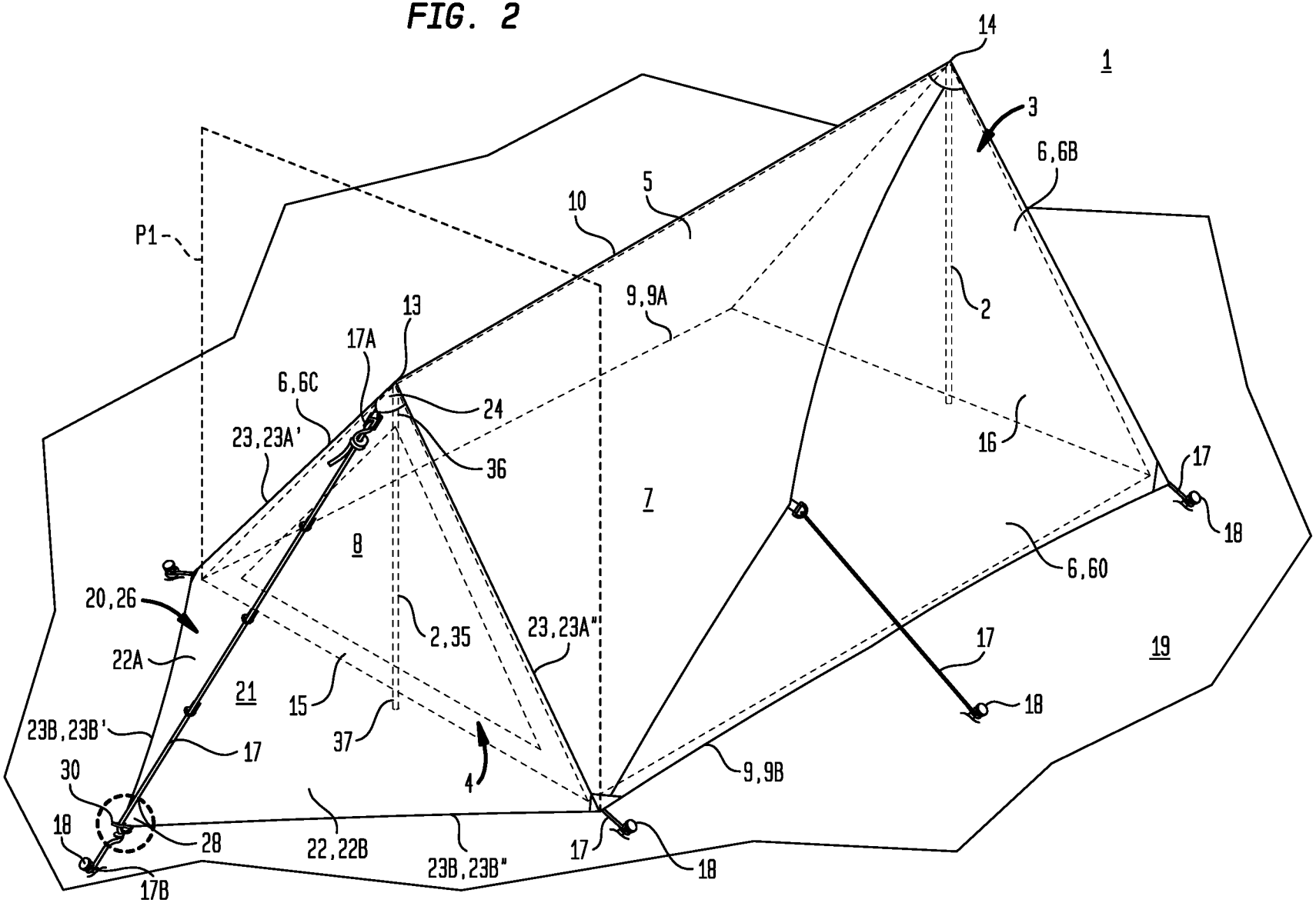
FIG. 2 is an illustration depicting a particular embodiment of the tent structure including a vestibule cover in the closed condition.

As shown by the illustrative examples of FIGS. 1 and 2, embodiments can include a tent outer cover (5) including one or more outer cover panels (6) configured and joined in a wide variety of structural configurations of the tent outer cover (5) which can be supported or suspended by the tent support structure (2) to afford a sheltered inside space (7) accessible by a tent entrance (8).

As shown in the example of FIG. 1, the tent structure (1) can include plurality of outer cover panels (6) each extending from an outer cover lower edge (9) to an outer cover vertex (11). One pair of outer cover panels (6A)(6B) can be disposed in upwardly extending opposed relation from corresponding plurality of outer cover lower edges (9) to an outer cover ridgeline (10) defining a tent entrance (8).

Figure 3:
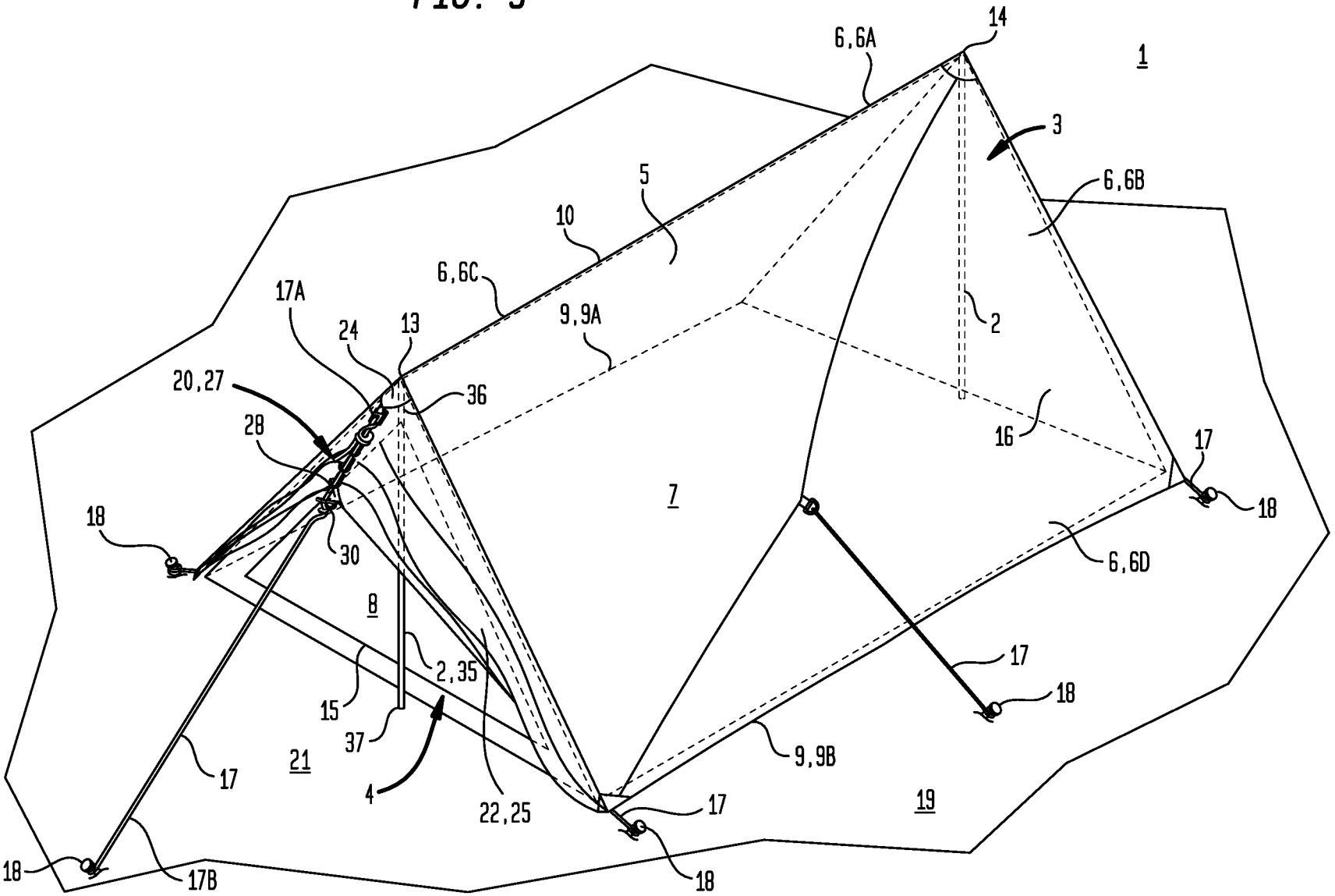
FIG. 3 is an illustration depicting the tent structure of FIG. 2 which shows a method of using a vestibule cover whereby the vestibule cover travels between a vestibule closed condition and a vestibule open condition.

As shown in the example of FIGS. 2 and 3, the tent outer cover (5) can include a pair of opposed outer cover panels (6C)(6D) correspondingly extending upwardly from outer cover lower edges (9A)(9B) to the outer cover ridge line (10) which extends between outer cover ridge line first and second ends (13)(14) which afford a tent entrance (8). Optionally, a tent first end panel (15) or a tent second end panel (16) can be joined to the opposed outer cover panels (6C)(6D) or suspended from the tent support structure (2). The tent first end panel (15) or tent second end panel (16) can unfasten to provide the tent entrance (8). The tent support structure (2) can, but need not necessarily, be secured to one or more guylines (17) which can be tensioned between the tent support structure (2) or tent outer cover (5) and one or more guyline anchors (18) secured to a support surface (19). The term "support surface" for the purposes of this invention means any surface on which an embodiment of the shelter or tent structure (1) can be disposed including naturally occurring ground surfaces or non-naturally occurring surfaces such as building floor surfaces, concrete pad surfaces, or the like.

Now, generally referring to FIGS. 1 through 9, embodiments of shelters or tent structures (1) can, but need not necessarily, include a vestibule cover (20) extending outward from the tent outer cover (5) to shelter a vestibule space (21), typically, in front of the shelter or tent entrance (8); however, this is not intended to preclude a vestibule cover (20) extending outward of the tent outer cover (5) to shelter a vestibule space (21) adjacent a tent side or at the rear of the shelter or tent structure (1). The vestibule cover (20) can include a flexible vestibule panel (22) extending outward to a vestibule panel periphery (23). The vestibule cover (20) can be made from the same material as the tent outer cover (5), such as: cotton, polyvinyl chloride coated canvas, polycotton, polyester, nylon, or combinations thereof.

In particular embodiments, the flexible vestibule panel (22) can include a vestibule panel periphery first portion (23) which can be configured to removably or fixedly coupled or directly attached to a corresponding portion of the of the outer cover panels (6) between the outer cover ridgeline (10)

and the outer cover lower edge (9) proximate the support surface (19) affording an uncoupled or unattached vestibule panel periphery second portion (23B) movable in relation to the shelter or tent structure (1).

Figure 4:
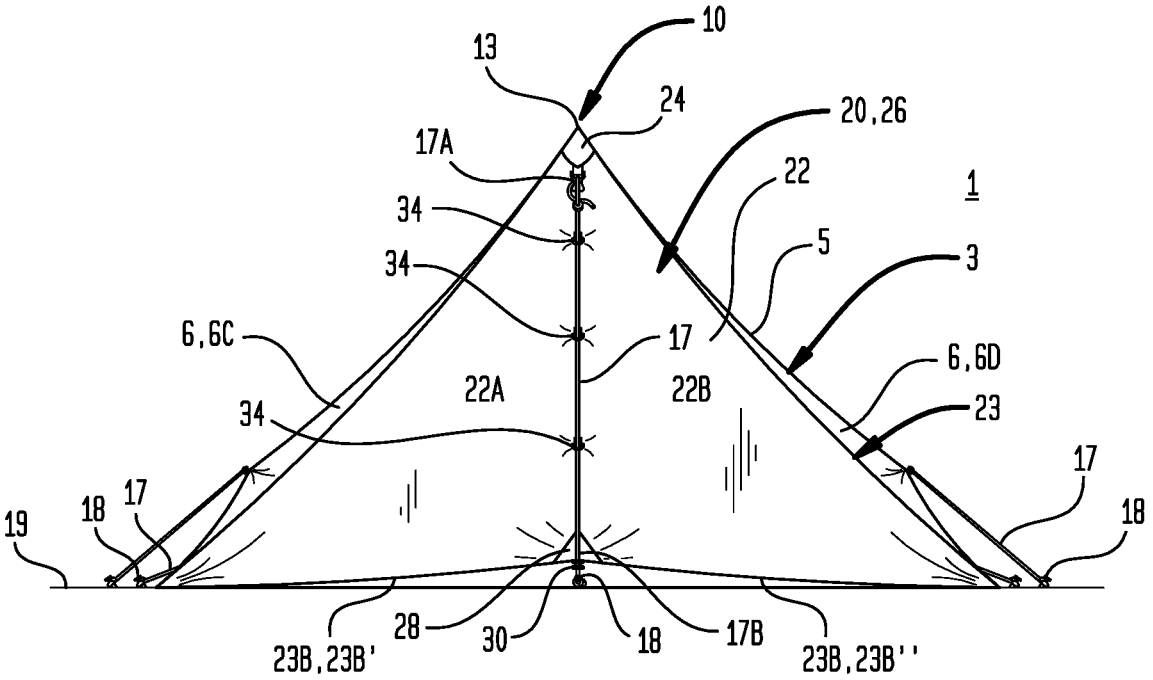
FIG. 4 is a front elevation view of the tent structure of FIG. 2 including an embodiment of the vestibule cover in the closed condition.
Figure 5:
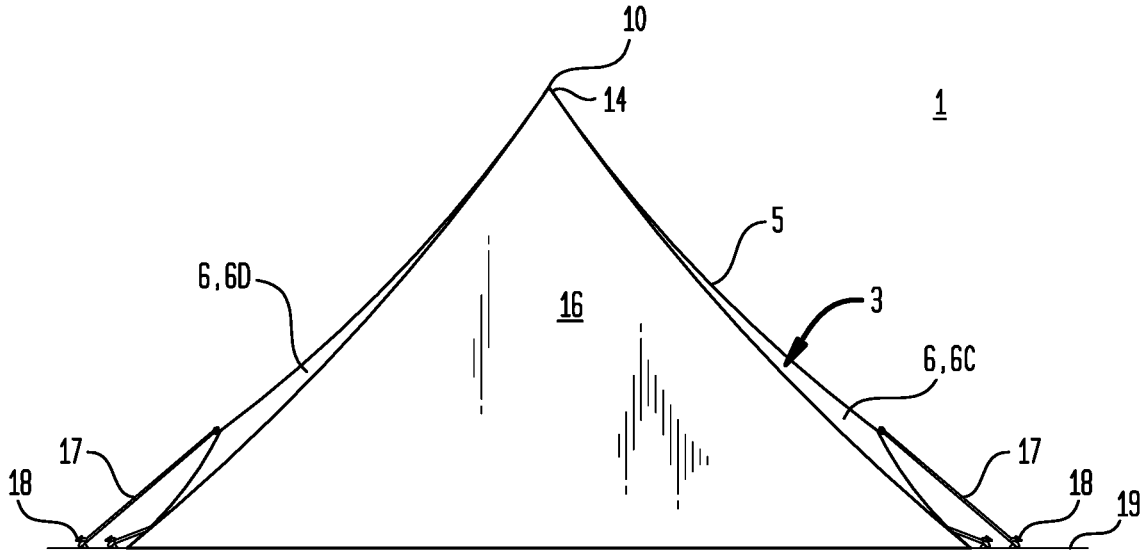
FIG. 5 is a rear elevation view of the tent structure of FIG. 2 including an embodiment of the vestibule cover in the closed condition.
Figure 6:
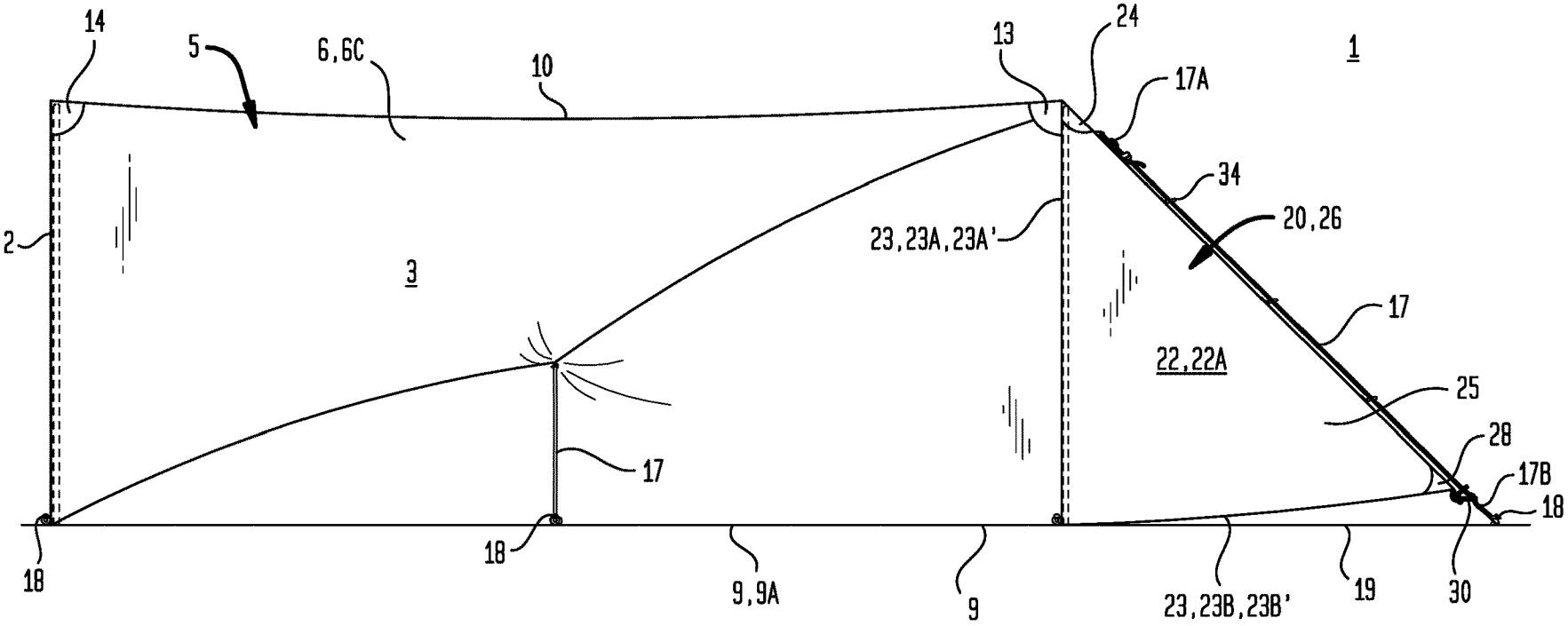
FIG. 6 is a first side elevation view of the tent structure of FIG. 2 including an embodiment of the vestibule cover in the closed condition.

Now referring primarily to FIGS. 2 through 4, in particular embodiments, the vestibule panel periphery first portion (23A) can include a first pair of vestibule panel edges (23A')(23A") each outwardly extending from a first vestibule panel vertex (24). The first pair of vestibule panel edges (23A')(23A") can be correspondingly coupled to an opposed pair of outer cover panels (6A)(6B) with the first vestibule panel vertex (24) of the vestibule panel periphery first portion (23A) coupled proximate or at the at the outer cover ridge line first or second ends (13)(14) and the first pair of adjacent vestibule panel edges (23A')(23A") correspondingly coupled along the each of the opposed pair of outer cover panels (6A)(6B) between the outer cover ridgeline (10) and the outer cover lower edges (9A)(9B).

Figure 7:
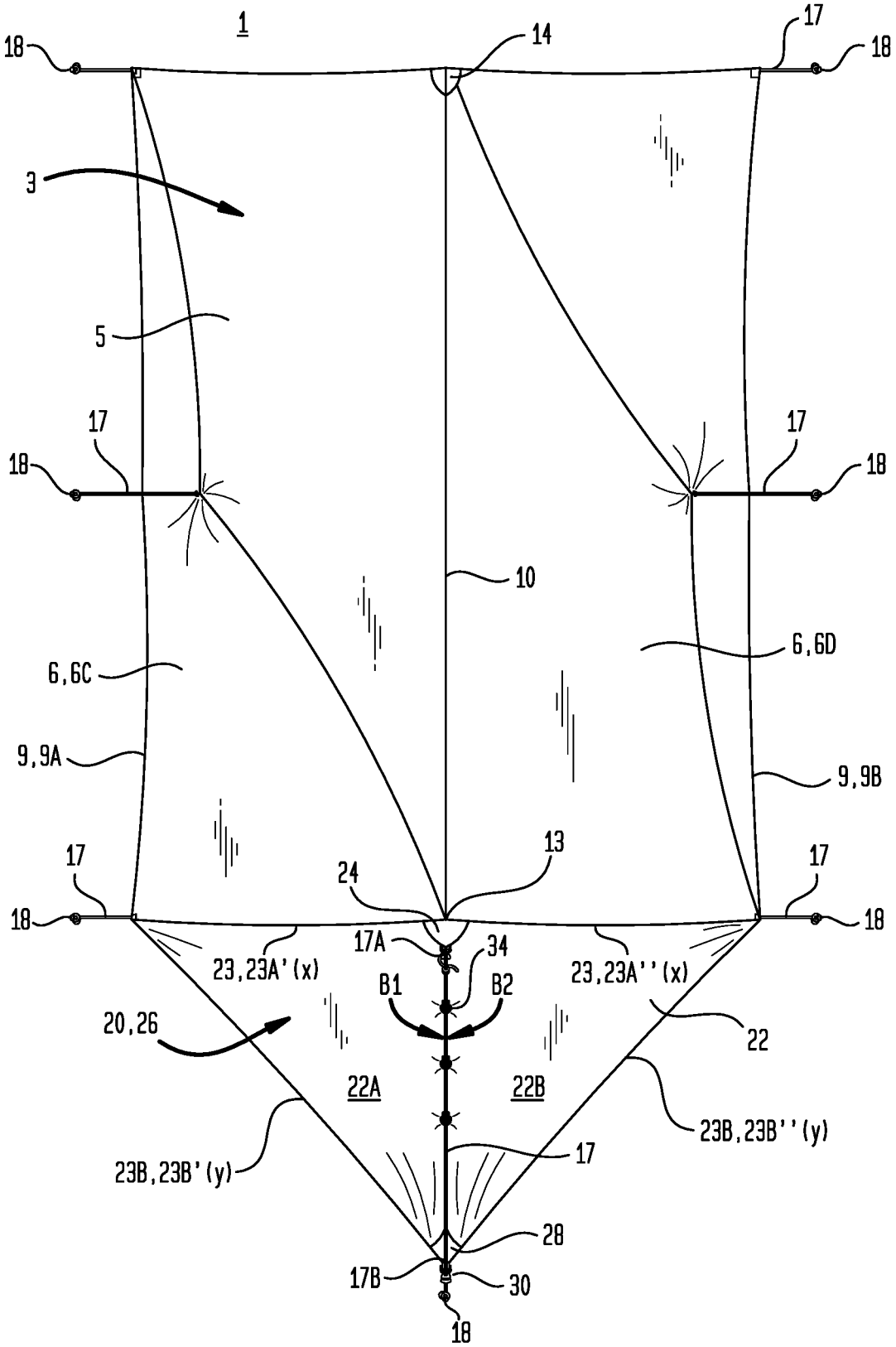
FIG. 7 is top plan view of the tent structure of FIG. 2 including an embodiment of the vestibule cover in the closed condition.

In particular embodiments, the first pair of adjacent vestibule panel edges (23A')(23A") can, but need not necessarily, have substantially equal length "X" as shown in the example of FIG. 7. While the pair of adjacent vestibule panel edges (23A')(23A") shown in the examples of FIGS. 1 and 2, are generally linear vestibule panel edges (23A')(23A") configured to correspondingly couple to the generally linear structure of the opposed pair of outer cover panels (6A)(6B) between the outer cover ridgeline (10) and the outer cover lower edges (9A)(9B); this does not preclude embodiments in which the vestibule panel periphery first portion (23A) has a non-linear configuration to correspondingly couple or attach to a non-linear configuration of the tent structure (1) with the vestibule panel periphery second portion (23B) unattached to the outer cover panels (9) and extendable outward of the shelter or tent shelter (1).

Again, referring primarily to FIGS. 1 and 2, in particular embodiments, the flexible vestibule panel (22) having the vestibule panel periphery first portion (23A) coupled to the corresponding portions of the outer cover panels (6) can be disposed over or suspended from a guyline (17) tensioned between the outer cover ridgeline (2) and a guyline anchor (18) secured to a support surface (19) at a location which generally aligns the tensioned guyline (17) with the outer cover ridgeline (10).

As shown in FIGS. 2 and 3, the flexible vestibule panel (22) disposed over or suspended from the guyline (17) allows the vestibule panel periphery second portion (23B) to define a vestibule cover moveable portion (25) of the flexible vestibule panel (22) which can travel over the guyline (17) between a vestibule panel closed condition (26) (as shown in the example of FIGS. 1 and 2) disposing the movable portion (25) or the vestibule panel periphery second portion (23B) proximate a guy line second end (17B) secured to the guyline anchor (18) thereby defining a covered vestibule space (21), which can be in front of the shelter or tent entrance (8), and a vestibule panel open condition (27) in which the vestibule movable portion (25) of the flexible vestibule panel (22) or the vestibule panel periphery second portion (23B) can be disposed proximate a guyline first end (17A) secured proximate or at the outer cover ridgeline (10) (as shown in the example of FIG. 3).

Now referring primarily to FIGS. 1 and 2, in particular embodiments, the vestibule panel periphery second portion (23B) can comprise a second pair of vestibule edges (23B') (23B") outwardly extending from each of the pair of outer cover panels (6A)(6B) at or proximate the outer cover lower edges (9A)(9B) to join at a vestibule panel second vertex (28). The vestibule panel second vertex (28) can be slidably coupled to the guyline (17) tensioned between the guyline first end (17A) coupled to a ridgeline first end (10) and a guy second end (17B) restrained by the guyline anchor (18) to the support surface (19). The vestibule second vertex (28) can slide along the guyline (17) between a vestibule panel closed condition (26) proximate said guyline second end (17B) and a vestibule panel open condition (27) proximate the ridgeline first end (17A). In particular embodiments, the vestibule panel periphery second portion (23B) can comprise a second pair of vestibule panel edges (23B')(23B") which can, but need not necessarily, have substantially equal length "Y" each extending from the corresponding outer cover lower edges (9A)(9B) to join at the vestibule panel second vertex (24).

In these particular embodiments, the flexible vestibule panel (22) can comprise a pair of triangular vestibule panels (22A)(22B) joined along corresponding bases ("B1" and "B2") between vestibule panel first and second vertices (24)(28). While the second pair of adjacent vestibule panel edges (23B')(23B") shown in the examples of FIG. 7, are generally a second pair of linear vestibule panel edges (23B')(23B") this is not intended to preclude embodiments in which the vestibule panel periphery second portion (23B) has a non-linear configuration.

In particular embodiments, the vestibule cover (20) can, but need not necessarily, be of an elastic material or an elastic member (29) can, but need not necessarily, be coupled to or proximate each of the second pair of vestibule panel edges (23B')(23B") to elastically tension each of the second pair of vestibule panel edges (23B')(23B"). Similarly, an elastic member (29) can, but need not necessarily, be coupled to the flexible vestibule panel (22) to elastically tension the flexible vestibule panel (22) between the first and second vertices (24)(28). The elastic member (29) can comprise any material which can be stretched and returns toward its original length, such as: rubber, butyl rubber, neoprene, polyisoprene, polyurethanes, polybutadiene, polyisobutylene, or the like and combinations thereof. The term "elastically tension" means for the purposes of this invention the act or action of stretching the elastic member (29) or the condition or degree of the elastic member (29) being stretched or being taut resulting from the elongation of the elastic member (29).

Now, with primary reference to FIGS. 2 through 7, in particular embodiments, the support structure (2) can generally dispose the first pair of vestibule panel edges (23A') (23A") in a plane (P1) plumb proximate the ridge line first end (13). As an illustrative example, the support structure can, but need not necessarily, include an upright support member (35) having a support member first end (36) which couples to the tent outer cover (5) proximate the ridge line first end (13) and a support member second end (37) which engages the support surface (19). The upright support member first and second ends (36)(37) can be generally disposed in a plane (P1) common to the first pair of vestibule panel edges (23A')(23A") and generally plump proximate the ridgeline first end (13).

Figure 8:
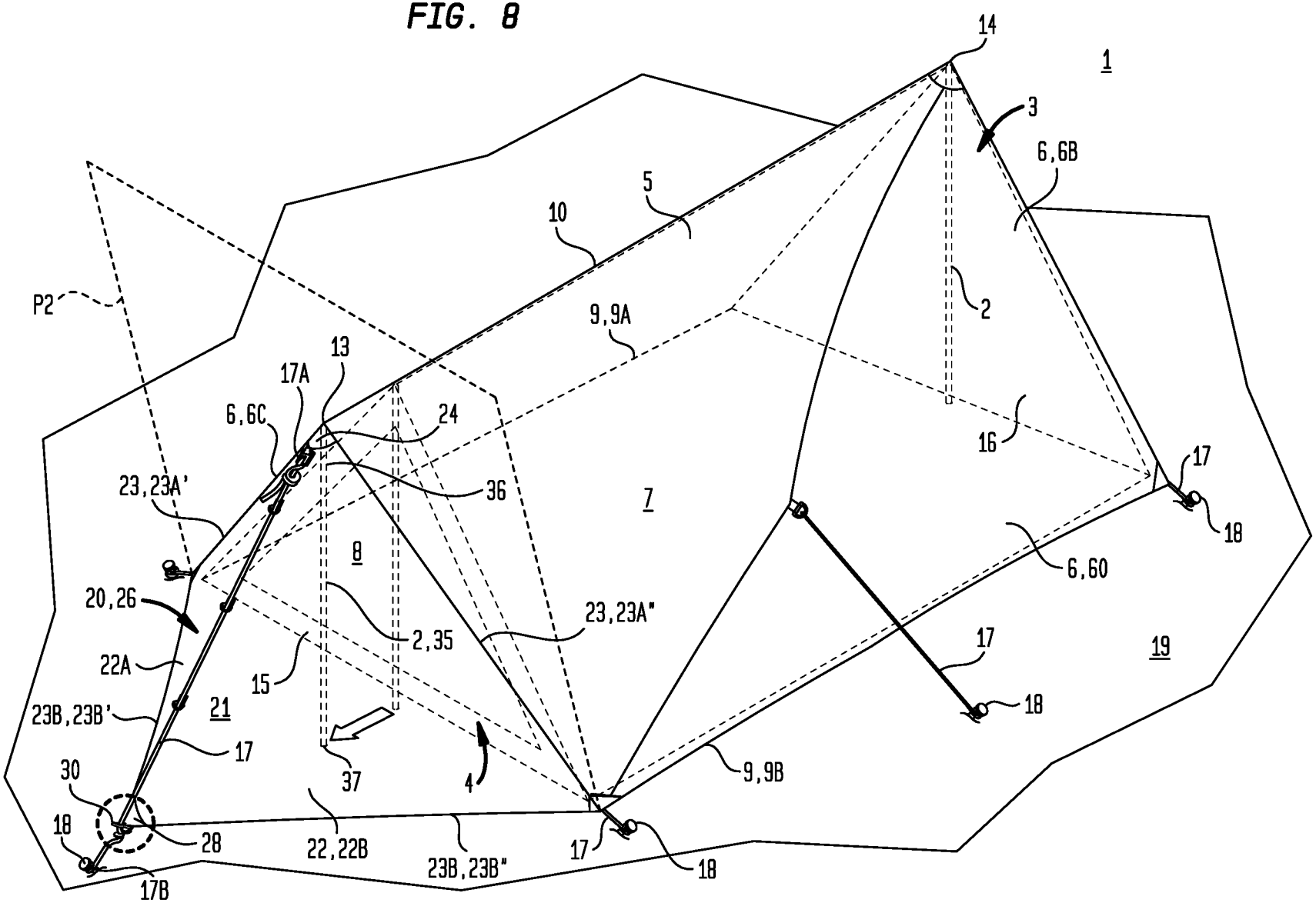
FIG. 8 is an illustration depicting a particular embodiment of tent structure including a vestibule cover in the closed condition.
Figure 9:
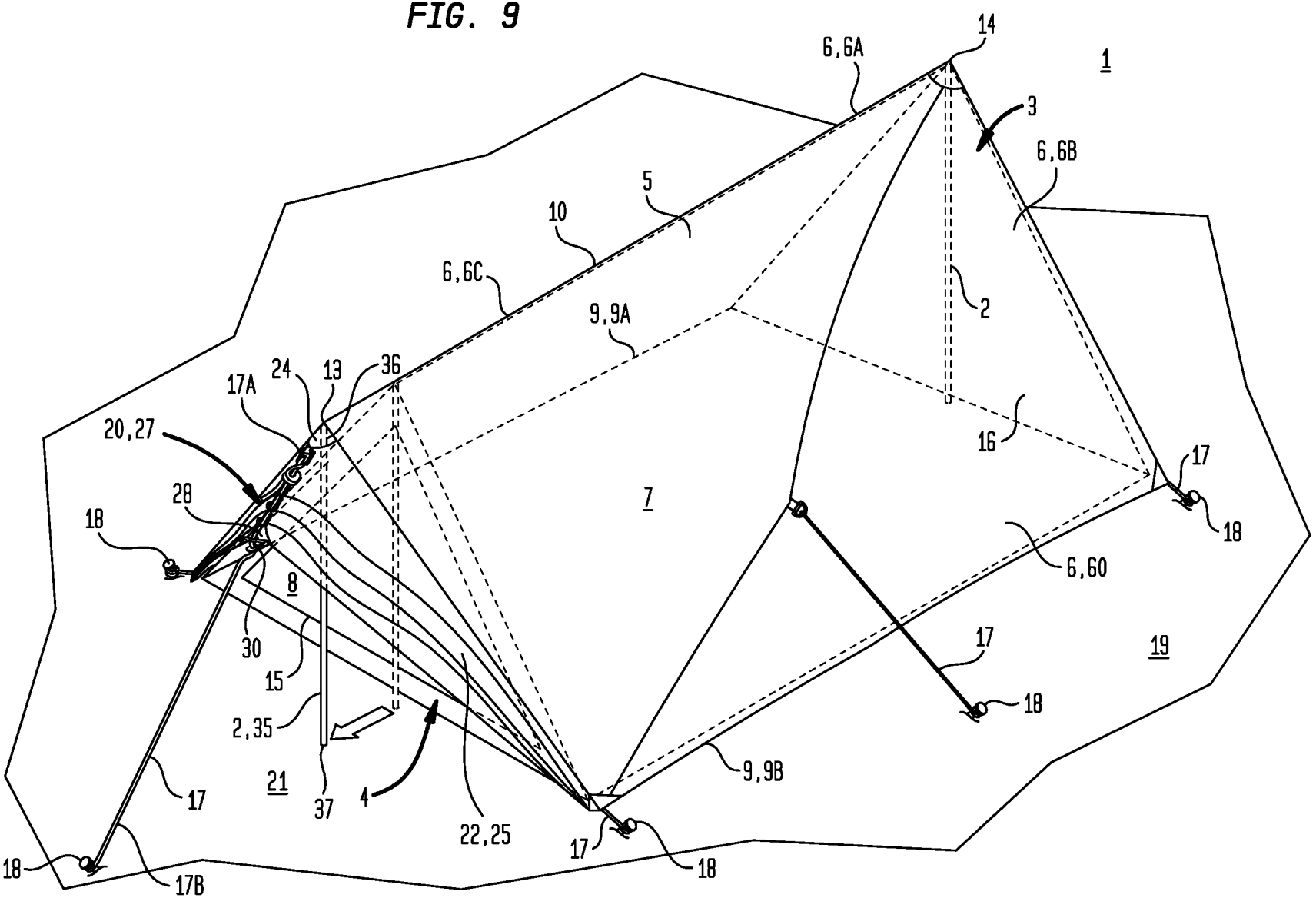
FIG. 9 is an illustration depicting the tent structure of FIG. 8 which shows a method of using a vestibule cover whereby the vestibule cover travels between a vestibule closed condition and a vestibule open condition.

Now, with primary reference to FIGS. 8 and 9, in particular embodiments, the support structure (2) can generally dispose the first pair of vestibule panel edges (23A')(23A") in a plane (P2) off plumb proximate the ridge line first end (13). Again, as an illustrative example, the support structure can, but need not necessary, include an upright support member (35) having a support member first end (36) which couples to the tent outer cover (5) proximate the ridge line first end (13) and a support member second end (37) which engages the support surface (19) to dispose the first pair of vestibule panel edges (23A')(23A") in a plane (P2) off plumb in relation to the ridge line first end (13). As to these embodiments, the length of vestibule panel edge (23A') and the length of vestibule panel edge (23B') can, but need not necessarily, have substantially equal length and the length of vestibule panel edge (23A") and the length of vestibule panel edge (23B") can, but need not necessarily, have substantially equal length; however, the length of vestibule panel edge (23A') and the length of vestibule panel edge (23B') while being of substantially equal length does not have to be equal to the length of vestibule panel edge (23A") and the length of vestibule panel edge (23B") which have substantially equal length. Accordingly, the vestibule cover (20) and the vestibule space (21) can be disposed in a wide variety of configurations encompassed by these dimensional relationships.

Now referring primarily to FIGS. 2, 3 and 8 and 9, and 11, in particular embodiments, a vestibule panel restraint (30) can, but need not necessarily, be coupled to the vestibule cover movable portion (25) of the flexible vestibule panel (22). In particular embodiments, the vestibule panel restraint (30) can be coupled to the vestibule panel periphery second portion (23B), and in particular embodiments, proximate the vestibule panel second vertex (28). The vestibule panel restraint (30) can operate to releasably fix the vestibule cover movable portion (25) of the flexible vestibule panel (22) at a location along the guyline (17).

Figure 11:
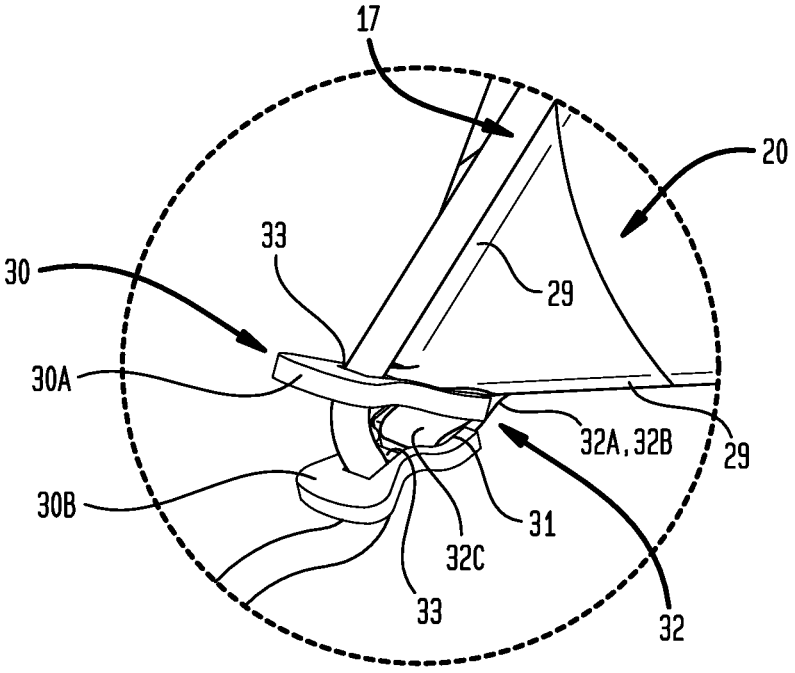
FIG. 11 is an enlargement of a portion of FIG. 2 showing an embodiment of a vestibule panel restraint operable to releasably fix said vestibule panel at a location along the guyline.

In the illustrative example of FIG. 11, the vestibule panel restraint (30) can comprise a pair of vestibule panel restraint main bodies (30A)(30B). A main body first aperture element (31) can communicate between opposed surfaces of each main body (30A)(30B). The pair of vestibule panel restraint bodies (30A)(30B) can be disposed in opposed adjacent relation and a flexible tether (32) can to pass through the main body first aperture element (31) of each main body (30A)(30B) and the opposite tether ends (32A)(32B) can be disposed in overlapping engagement to form a tether loop (32C). The pair of vestibule panel restraint main bodies (30A)(30B) can be disposed in opposed adjacent relation on the tether loop (32C). The flexible tether (32) can be fastened by overlapping tether ends (32A)(32B) to the moveable portion (25) of the flexible vestibule panel (22). In particular embodiments, the flexible tether (32) can be fastened to or proximate the vestibule panel second vertex (28). The illustrative example of disposing the pair of vestibule panel restraint main bodies (30A)(30B) on a tether loop (32C) is not intended to preclude other types of fastener from being utilized to secure the pair of vestibule panel restraint main bodies (30A)(30B) to the moveable portion (25) of the flexible vestibule panel (22) which can be achieved by mechanical fasteners, adherents, or heat fusion of the vestibule panel restraint main bodies (30A)(30B) to the flexible vestibule cover (22). In particular embodiments, the pair of vestibule panel restraint main bodies (30A)(30B) can be made as a one-piece pair of main bodies (30A/30B) having living hinge joining the pair of vestibule panel restraint main bodies (30A)(30B).

The pair of vestibule panel restraint main bodies (30A)(30B) can each further include a main body second aperture element (33). The second aperture element (33) in each of the pair of restraint bodies (30A)(30B) can be configured to afford passage of the guyline (27). The guyline (17) can then be tensioned between the guyline first end (17A) coupled to a ridgeline (10) and the guy second end (17B) restrained by the guyline anchor (18) to the support surface (19). The pair of restraint main bodies (30A)(30B) when disposed in separated angled relation to one another can pinch the guyline (17) to maintain the vestibule panel restraint (30) at a fixed location along the tensioned guyline (17). Forcible urging of the pair of restraint main bodies (30A)(30*b*) toward one another can reduce the level of pinch on the guyline (17) and allow the vestibule panel restraint (30) to travel along the tensioned guyline (17) between the vestibule panel open condition (27) and the vestibule panel closed condition (26).

In particular embodiments, a suitable pair of restraint main bodies (30A)(30B) can take the form of pair of discrete line locks which are available as PN: GED000F available from Backcountry.com. However, this illustrative example is not intended to preclude the use of other types of vestibule panel restraints (30), such as conventional line tensioners, or line locks which can be fastened to the movable portion (25) of the vestibule panel (22), as illustrative examples: cordage ties, rubber grommets, LINE-LOK® Guyline Adjusters available from Litesmith, 34145 Pacific Coast Hwy, Unit 360, Dana Point, Calif. 92629, or combinations thereof or equivalents.

Figure 10:
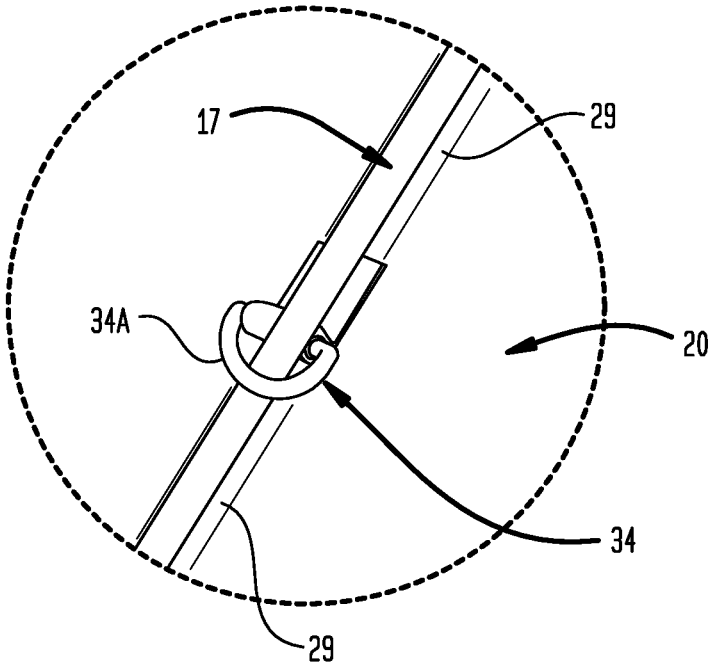
FIG. 10 is an enlargement of a portion of FIG. 2 showing an embodiment of a suspension element slidably disposed on a guyline and coupled to an embodiment of the vestibule panel.

Now referring primarily to FIGS. 2, 8 and 10, in particular embodiments, the tensioned guyline (17) can pass through one or more vestibule panel suspension elements (34) coupled to the vestibule panel (22) between the vestibule panel restraint element (30) and the ridgeline (10). The vestibule panel suspension elements (34) can take the form of one or more annular members (34A) secured to the vestibule panel (22). Each annular member (34A) has a suspension element aperture (35) through which the tensioned guyline (17) passes and along which the vestibule panel suspension elements (34) slide as the vestibule panel (22) moves between the vestibule panel open conditions (27) and the vestibule panel closed condition (26). The suspension elements (34) can assist in reducing the amount of drape or sag in the vestibule panel (22) in relation to the tensioned guyline (17). In particular embodiments, the one or more vestibule panel suspension elements (34) can be disposed along the baseline (B1/B2) between vestibule panel first and second vertices (24)(28).

Figure 12:
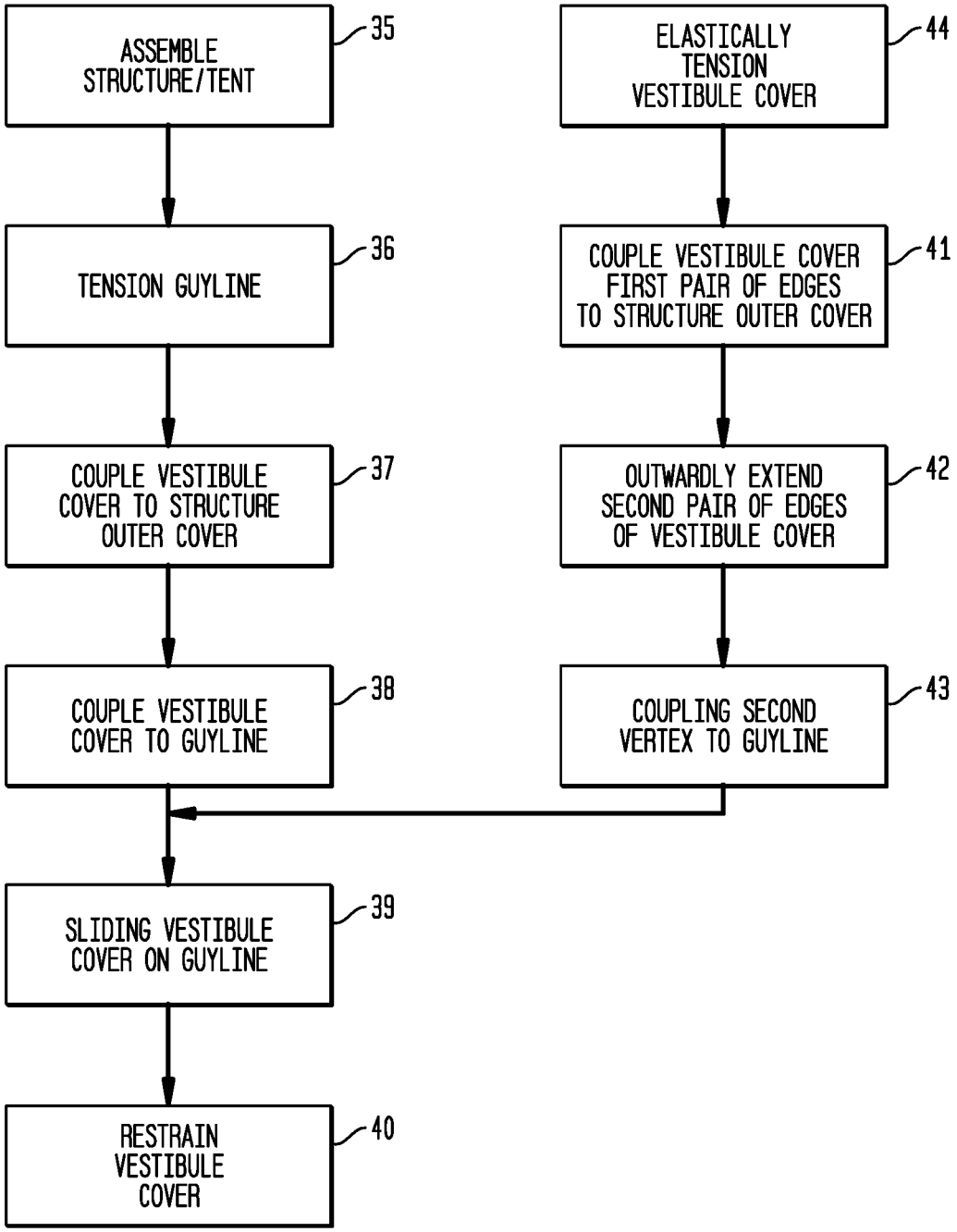
FIG. 12 is a block flow diagram of methods of using embodiments of the tent structure including a vestibule panel.

Now, referring to FIG. 12, methods of making and using embodiments of the shelter or tent structure can include one or more of: assembling a shelter or tent structure having at least one pair of outer cover panels (6A)(6B) each extending upwardly from each outer cover panel lower edge (9A)(9B) to an outer cover ridgeline (10)(shown as block (35)), tensioning a guyline (17) between a guyline first end (17A) coupled proximate a ridge line first end (13) and a guy second end (17B) anchored to a support surface (19)(shown as block (36)), coupling a vestibule cover periphery first portion (23A) of a flexible vestibule panel (22) to the pair of outer cover panels (6A)(6B) between each outer cover panel lower edge (9A)(9B) and the ridge line first end (13)(shown as block (37)), slidably coupling the flexible vestibule panel (22) to the guyline (17) (shown as block (38)), sliding said flexible vestibule panel (22) along the guyline (17) between an vestibule panel closed condition (26) proximate said guyline second end (17B) and an vestibule panel open condition (27) proximate a guyline first end (17A) (shown as block (39), operating a vestibule panel restraint (30) to releasably fix a vestibule panel periphery second portion (23B) at a location along the guyline (17) (shown as block (40)).

In particular embodiments, the method can further include one or more of coupling a vestibule cover periphery first portion (23A) of a flexible vestibule panel (22) having a first pair of adjacent vestibule edges (23A')(23A") extending to a vestibule panel first vertex (24) to a corresponding opposed pair of outer cover panels (6A)(6B) correspondingly extending upwardly from corresponding outer cover lower edges (9A)(9B) to an outer cover ridgeline (10) (shown as block 41), outwardly extending a second pair of adjacent vestibule edges (23B')(23B") terminating in a vestibule panel second vertex (28) from each of the pair of outer cover panels (6A)(6B) at corresponding outer cover lower edges (9A)(9B)(shown as block (42)), slidably coupling said vestibule panel second vertex (28) to the guyline (17) tensioned between the guyline first end (17A) and the guyline second end (17B)(shown as block (43)).

In particular embodiments, the method can further include elastically tensioning one or more of the second pair of adjacent vestibule edges (23B')(23B") or the flexible vestibule cover (22) between the vestibule panel first and second vertices (24)(28)(shown as block (44)).

As can be easily understood from the foregoing, the basic concepts of the present invention may be embodied in a variety of ways. The invention involves numerous and varied embodiments of a shelter or tent vestibule panel and methods for making and using such shelter or tent vestibule panel including the best mode.

As such, the particular embodiments or elements of the invention disclosed by the description or shown in the figures or tables accompanying this application are not intended to be limiting, but rather illustrative of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "cover" should be understood to encompass disclosure of the act of "covering"—whether explicitly discussed or not—and, conversely, were there effectively disclosure of the act of "covering", such a disclosure should be understood to encompass disclosure of a "cover" and even a "means for covering." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in Merriam-Webster's Collegiate Dictionary, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the structures or tent structures herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A shelter having a pair of outer cover panels each upwardly extending to an outer cover ridgeline, said shelter further comprising:

a flexible vestibule panel extending to a vestibule panel periphery including a pair of vestibule panel edges correspondingly joined to said pair of outer cover panels, said flexible vestibule panel slidably attached by a suspension element to a guyline disposed between a guyline first end coupled proximate said outer cover ridge line and a guyline second end anchored to a support surface, said flexible vestibule panel slidably attached to said guyline by said suspension element slides along said guyline between a vestibule panel closed condition disposing a movable portion of said vestibule panel proximate said guyline second end and a vestibule panel open condition disposing said movable portion of said flexible vestibule panel proximate said guyline first end.

2. The shelter of claim 1, wherein said movable portion of said vestibule panel periphery extends to a second pair of vestibule panel edges.

3. The shelter of claim 2, wherein said first pair of vestibule panel edges have substantially equal length and wherein said second pair of vestibule panel edges have substantially equal length.

4. The shelter of claim 2, wherein said first pair of vestibule panel edges having substantially equal length have a different length than said second pair of vestibule panel edges having substantially equal length.

5. The shelter of claim 2, wherein said pair of vestibule panel edges comprise a first pair of vestibule panel edges having substantially equal length, and wherein said movable portion of said vestibule panel periphery comprises a second pair of vestibule panel edges having substantially equal length.

6. The shelter of claim 2, further comprising elastic members disposed along each of said second pair of vestibule panel edges.

7. The shelter of claim 2, further comprising one or more flexible vestibule panel suspension elements coupled to said flexible vestibule panel between said vestibule panel first and second vertices, said flexible vestibule suspension element slidable along said guyline between said guyline first end coupled proximate a ridge line first end, and said guyline second end anchored to said support surface.

8. The shelter of claim 1, further comprising a vestibule panel restraint coupled to said movable portion of said flexible vestibule panel, said vestibule panel restraint operable to releasably fix said movable portion of said flexible vestibule panel at a location along said guyline.

9. The shelter of claim 8, further comprising an elastic member disposed on said flexible vestibule panel between said vestibule panel first vertex and said vestibule panel second vertex.

10. The shelter of claim 1, wherein said pair of vestibule panel edges correspondingly coupled to said pair of outer cover panels disposes said first pair of vestibule panel edges in a plane substantially plumb to the ridge line first end.

11. A shelter having a pair of outer cover panels each upwardly extending to an outer cover ridgeline, said shelter further comprising:

a flexible vestibule panel extending to a vestibule panel periphery including a first pair of vestibule panel edges which correspondingly couple to said pair of outer cover panels, said flexible vestibule panel slidably attaches to a guyline disposed between a guyline first end coupled proximate said outer cover ridge line and a guyline second end anchored to a support surface, said flexible vestibule panel when attached to said guyline slides along said guyline between a vestibule panel closed condition disposing a movable portion of said vestibule panel proximate said guyline second end and a vestibule panel open condition disposing said movable portion of said flexible vestibule panel proximate said guyline first end; wherein said movable portion of said vestibule panel periphery extends to a second pair of vestibule panel edges; and said first pair of vestibule panel edges terminate at a vestibule panel first vertex disposed proximate said outer cover ridgeline, and wherein said second pair of vestibule panel edges terminate at a vestibule panel second vertex.

12. The shelter of claim 11, wherein said flexible vestibule panel comprises a pair of triangular flexible vestibule panels joined along corresponding bases between said vestibule panel first and second vertices.

13. A shelter having a pair of outer cover panels each upwardly extending to an outer cover ridgeline, said shelter further comprising:

a flexible vestibule panel extending to a vestibule panel periphery including a pair of vestibule panel edges which correspondingly couple to said pair of outer cover panels, said flexible vestibule panel slidably attaches to a guyline disposed between a guyline first end coupled proximate said outer cover ridge line and a guyline second end anchored to a support surface, said flexible vestibule panel when slidably attached to said guyline by a suspension element slides along said guyline between a vestibule panel closed condition disposing a movable portion of said vestibule panel proximate said guyline second end and a vestibule panel open condition disposing said movable portion of said flexible vestibule panel proximate said guyline first end;

wherein said pair of vestibule panel edges terminate at a vestibule panel vertex disposed proximate said outer cover ridge line, and wherein said pair of vestibule panel edges and vertex reside in a plane substantially off plumb to the ridge line first end, wherein said plane at said vestibule panel vertex tilts in a forward direction.

14. A vestibule panel to retrofit a tent, comprising:

a flexible vestibule panel configured to retrofit an existing tent, said flexible vestibule panel extending to a vestibule panel periphery including a first pair of adjacent vestibule panel edges configured to correspondingly releasably attach to at least one pair of opposed outer cover panels each extending from an outer cover panel lower edge to an outer cover panel ridgeline, said flexible vestibule panel slidably attaches by a suspension element to a guyline disposed between a guyline first end coupled proximate said outer cover ridge line and a guyline second end restrained proximate a support surface, said flexible vestibule panel when slidably attached to said guyline by said suspension element slides along said guy line between a vestibule panel closed condition disposing a movable portion of said flexible vestibule panel proximate said guyline second end and a vestibule panel open condition disposing said movable portion of said vestibule panel proximate said guyline first end.

* * * * *